US006435852B1

(12) United States Patent
Ho

(10) Patent No.: US 6,435,852 B1
(45) Date of Patent: Aug. 20, 2002

(54) ROTARY PUMP

(76) Inventor: Kuo-Ching Ho, No. 2, Lane 2, Sungju Rd., Taichung (TW)

( * ) Notice: Subject to any disclaimer, the term of this patent is extended or adjusted under 35 U.S.C. 154(b) by 0 days.

(21) Appl. No.: 09/760,696

(22) Filed: Jan. 17, 2001

(51) Int. Cl.[7] ..... F04C 18/00
(52) U.S. Cl. ..... 418/268; 418/266; 418/267
(58) Field of Search ..... 418/267, 268, 418/266

(56) References Cited

U.S. PATENT DOCUMENTS

| | | | | | |
|---|---|---|---|---|---|
| 49,070 | A | * | 8/1865 | Bickford | 418/267 |
| 3,886,764 | A | * | 6/1975 | Edwards | 418/225 |
| 4,990,074 | A | * | 2/1991 | Nakagawa | 418/268 |

FOREIGN PATENT DOCUMENTS

| | | | | |
|---|---|---|---|---|
| JP | 05-118282 | * | 5/1993 | 418/266 |
| SU | 1707240 | * | 1/1992 | 418/268 |

* cited by examiner

*Primary Examiner*—Thomas Denion
*Assistant Examiner*—Theresa Trieu

(57) ABSTRACT

A rotary pump includes a casing having a rotator rotatably received therein and a shaft fixedly extends through the rotator. The shaft is located eccentrically in the casing. An inlet and an outlet are defined through the casing and a receiving area is defined longitudinally in an outer periphery of the rotator. A pushing assembly has an end pivotally received in the receiving area and the other end of the pushing assembly either rotatably contacts an inner periphery of the casing or is either received in the receiving assembly during the rotation of the rotator to suck liquid from the inlet or push liquid out from the outlet.

1 Claim, 6 Drawing Sheets

ROTARY PUMP

FIELD OF THE INVENTION

The present invention relates to a rotary having a pivotable member connected to the rotor so that the pivotable member extends to contact the inner periphery of the casing and is folded according to the position of the rotor in the casing.

BACKGROUND OF THE INVENTION

A conventional rotary pump is shown in FIGS. 1 and 2 and generally includes a casing 11 with a cylindrical space 12 in which a rotor 13 is rotatably received. The rotor 13 has a shaft 10 connected to a center thereof and the shaft 10 is driven by a proper mechanism so as to let the rotor 13 rotate within the cylindrical space 12. Two passages 14, 140 are respectively defined radially in the rotor 13 and two plates 15, 150 are respectively received in the two passages 14, 140. When the rotor 13 rotates, the two plates 15, 150 are pushed outward to contact the inner periphery defining the cylindrical space 12 by eccentric force. By this way, the liquid in the room between the inner periphery defining the cylindrical space 12 and the rotor 13 can be pushed by the plates 15, 150 from the outlet 122. Liquid enters the room from the inlet 121 because the lower pressure in a partition in the room. However, the plates 15, 150 cannot snugly contact the inner periphery of the cylindrical space 12 as expected so that the efficiency is low.

The present invention intends to provide a rotary pump having a pivotable pushing assembly which can be received in recesses in the rotor or extended to contact the inner periphery of the casing.

SUMMARY OF THE INVENTION

In accordance with one aspect of the present invention, there is provided a rotary pump comprising a casing having a rotator rotatably received therein and a shaft fixedly extends through the rotator. The shaft is located eccentrically in the casing. A receiving area is defined longitudinally in an outer periphery of the rotator. An inlet and an outlet are defined through the casing. A pushing assembly has an end pivotally received in the receiving area and the other end of the pushing assembly rotatably contacts an inner periphery of the casing.

The primary object of the present invention is to provide a rotary pump wherein a pushing assembly is pivotally connected to the rotator and an end of the pushing assembly air-tightly contacts the inner periphery of the casing so as to obtain a high efficient pumping feature.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
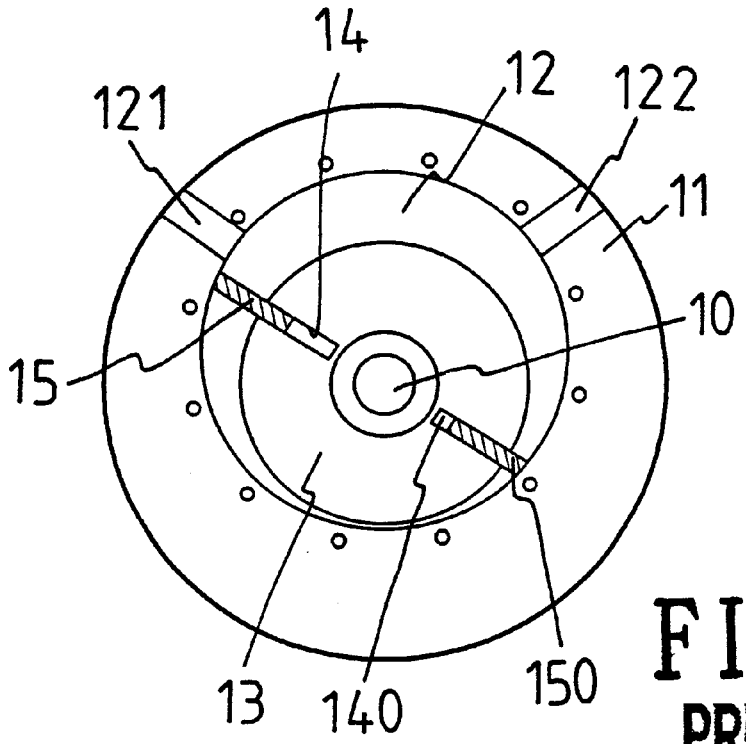
FIG. 1 PRIOR ART
FIGS. 1 and 2 show a plan view of a conventional rotary pump.
Figure 2:
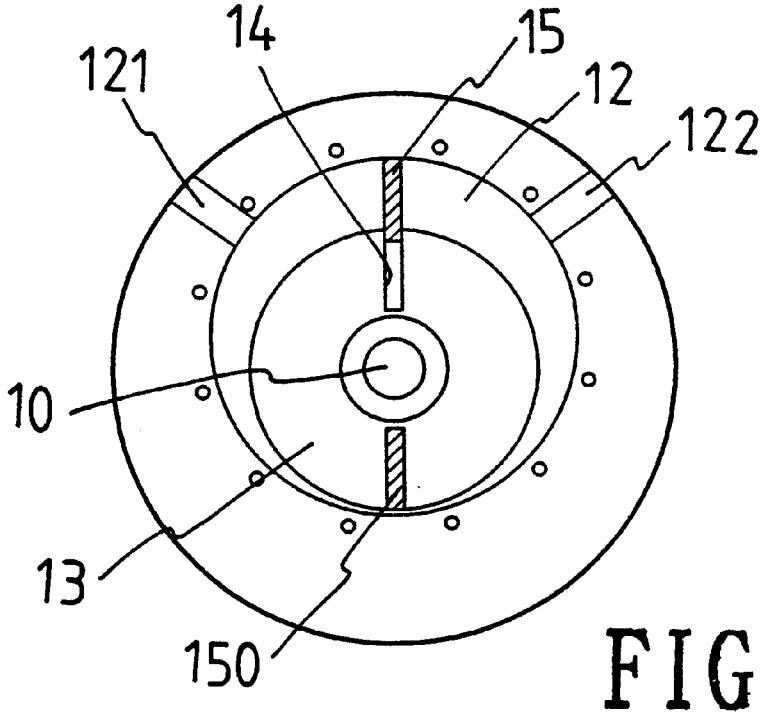
FIG. 2 PRIOR ART
Figure 3:
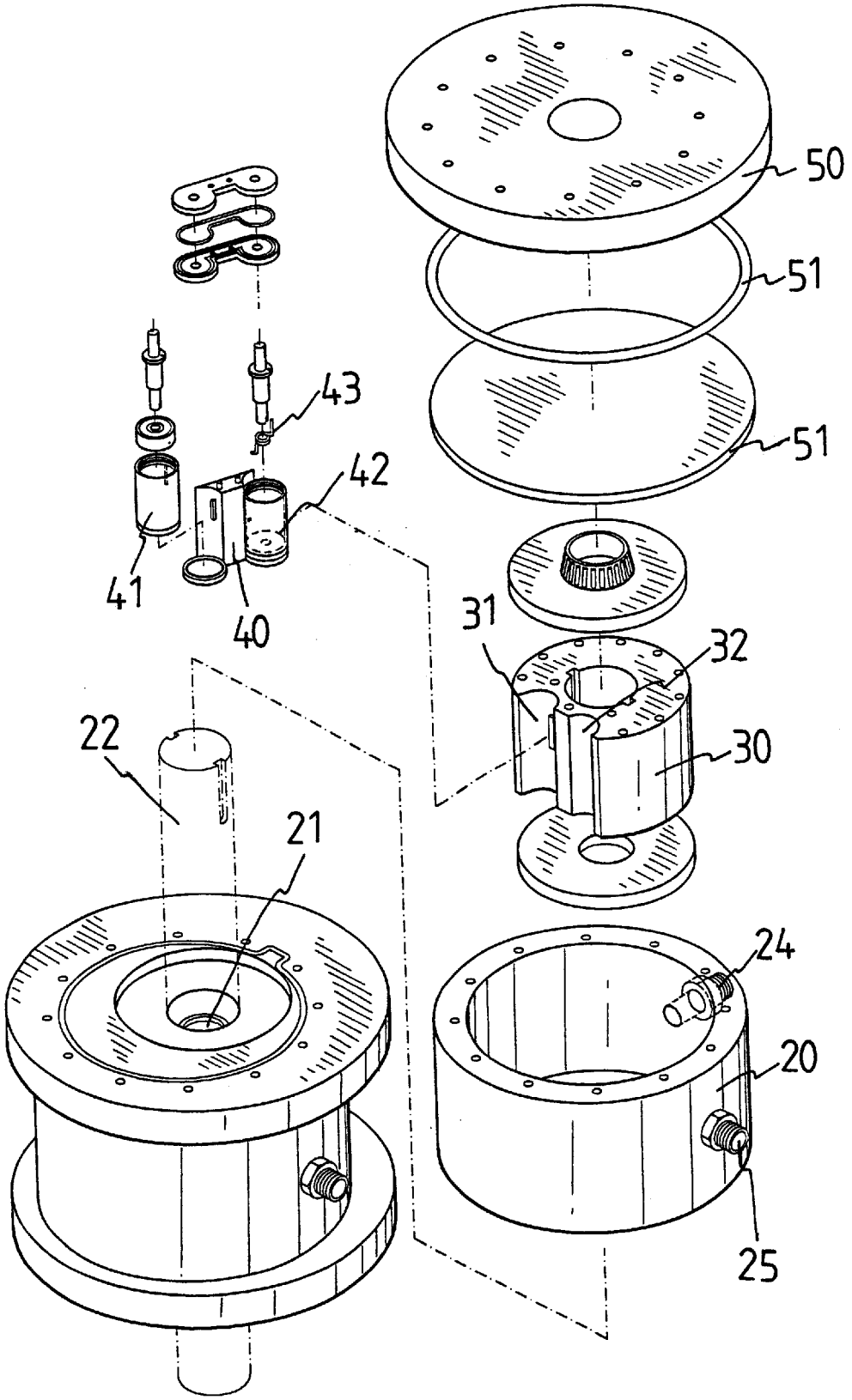
FIG. 3 is an exploded view to show a rotary pump of the present invention.
Figure 4:
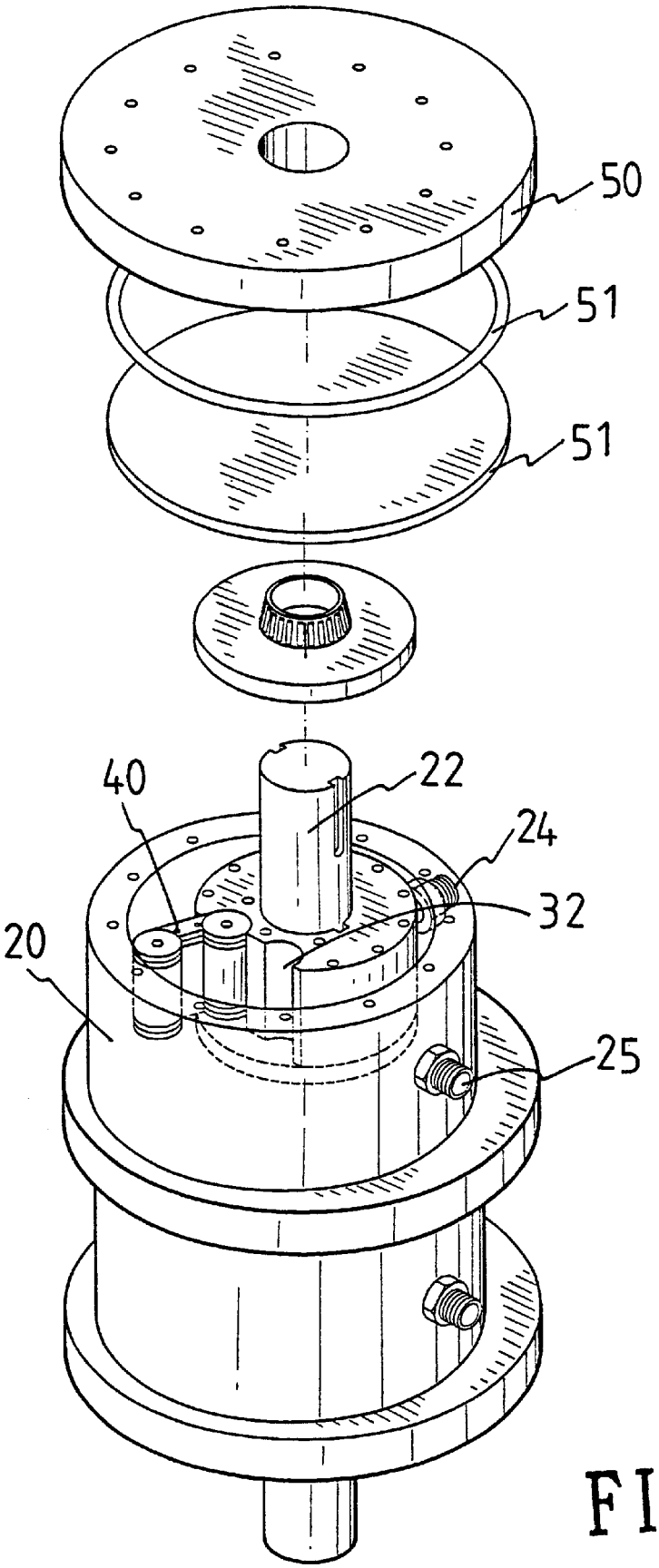
FIG. 4 is an exploded view to show the rotary pump of the present invention and a top cover of the pump.
Figure 5:
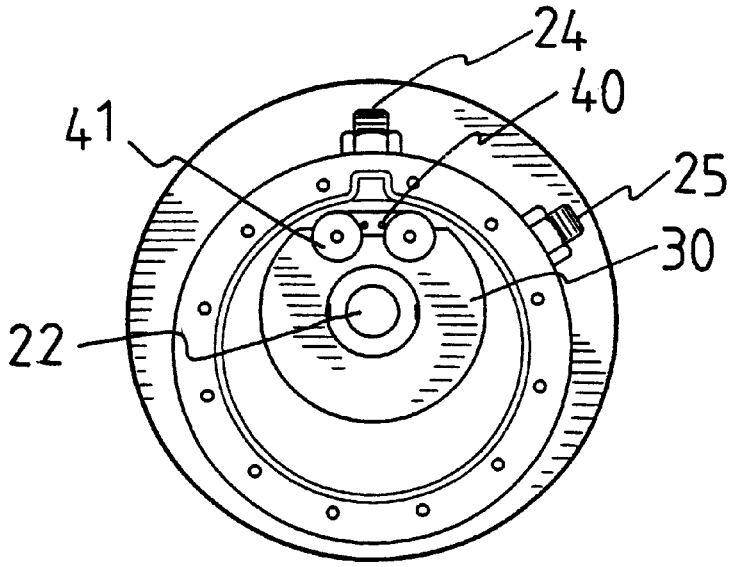
FIG. 5 shows a plan view of the rotary pump of the present invention.
Figure 9:
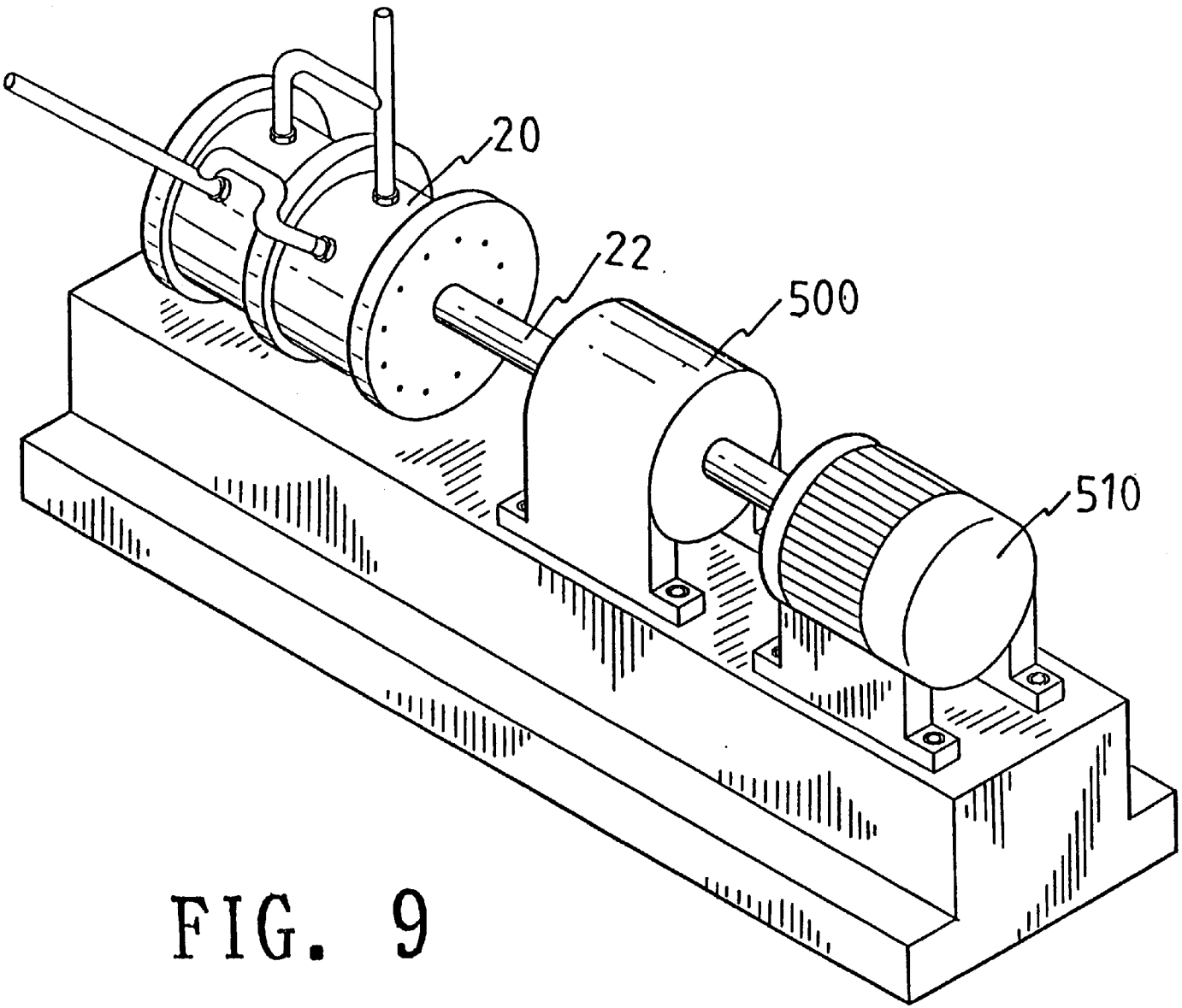
FIG. 9 is a perspective view to show the rotary pump of the present invention connected to a motor.

Referring to FIGS. 3 to 5, the rotary pump of the present invention comprises a casing 20 having a rotator 30 rotatably received therein and the rotor 30 has a hole 21 for a shaft 22 fixedly extending therethrough. The shaft 22 is eccentrically located in the casing 20 and driven by a motor 510 which is connected with a gear reduction means 500 as shown in FIG. 9. A receiving area including a first recess 31 and a second recess 32 are defined longitudinally in an outer periphery of the rotator 30. An inlet 24 and an outlet 25 are defined through the casing 20 and communicate with an interior of the casing 20.

A pushing assembly is connected to the rotor 30 and includes a connection member 40. A first member 41 is rotatably connected to a first end of the connection member and a second member 42 rotatably connected to a second end of the connection member 40. The second member 42 is fixedly received in the first recess 31. A torsion spring 43 is connected between the first member 41 and the second member 42 so as to normally let the first member 41 contact an inner periphery of the casing 20. The first member 41 rotatably contacting an inner periphery of the casing 20. A top cover 50 is connected to the casing 20 together with seals 51 so that liquid as shown in FIGS. 6 and 7 are received in the interior of the casing 20.

Figure 6:
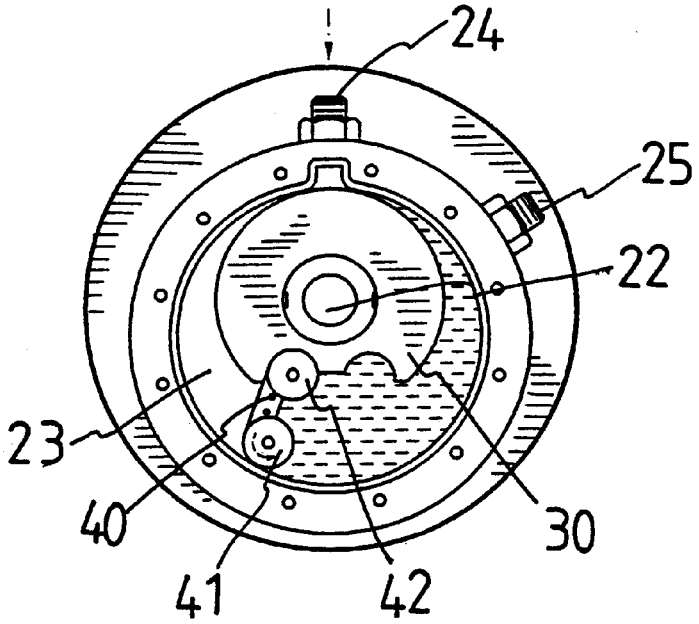
FIG. 6 shows a plan view of the rotary pump of the present invention wherein liquid in the casing is pushed by the pushing assembly.
Figure 7:
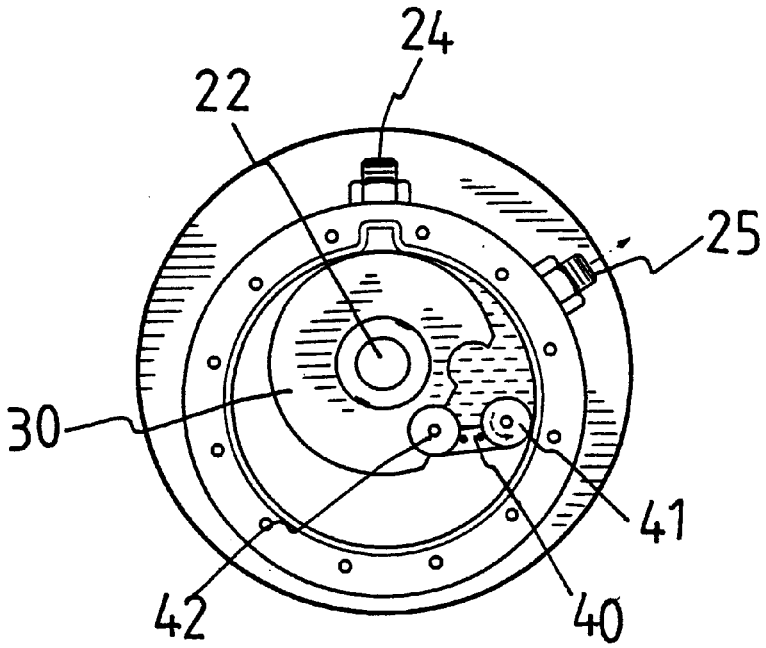
FIG. 7 shows a plan view of the rotary pump of the present invention wherein liquid in the casing is pushed out from the outlet of the rotary pump of the present invention.

As shown in FIGS. 6 and 7, when the rotor 30 is rotated in the casing 20, the pushing assembly is expanded and the liquid is pushed by the connection member 40 and the first member 41 so that the liquid is pushed out from the outlet 25 during the rotation of the rotor 30. When the rotor 30 is rotated to a position where the space between the rotor 30 and the inner periphery of the casing 20 is narrow, the connection member 40 is pushed by the inner periphery of the casing 20 and the first member 41 is received in the second recess 32. At this position, the liquid will be sucked in the casing 20 from the inlet 24 because a lower pressure is formed in the casing 20. The pushing assembly is maintained to contact the inner periphery of the casing 20 by the torsion spring 43 so that the first member 41 snugly contacts the inner periphery of the casing 20 so that the efficiency is increased. The first member 41 can be received in the second recess 32 to reduce the volume of the rotor 30.

Figure 8:
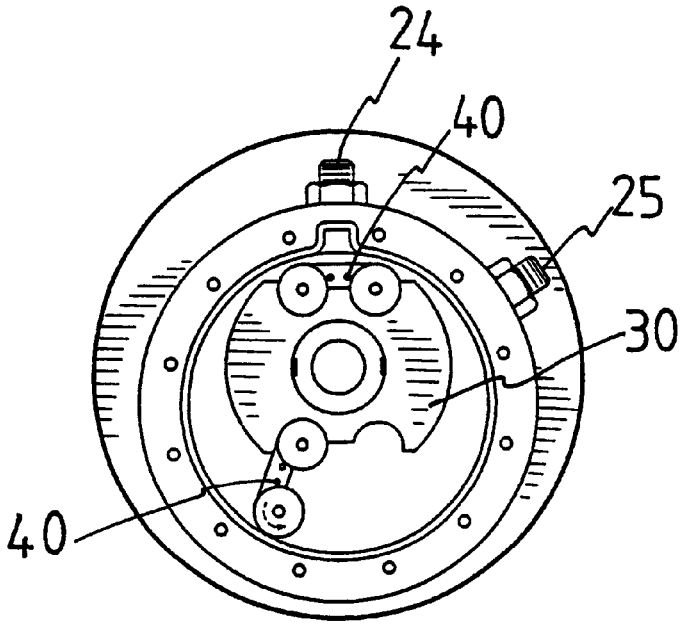
FIG. 8 is a plan view to show another embodiment of the present invention.

FIG. 8 shows that the number of the recesses and the pushing assembly can be added as desired so as to increase the force applied to the liquid in the casing 20.

While we have shown and described various embodiments in accordance with the present invention, it should be clear to those skilled in the art that further embodiments may be made without departing from the scope and spirit of the present invention.

What is claimed is:

1. A rotary pump comprising:

a casing having a rotator rotatably received therein and a shaft fixedly extending through said rotator, said shaft located eccentrically in said casing, a receiving area defined longitudinally in an outer periphery of said rotator, an inlet and an outlet defined through said casing, said receiving area including a first recess and a second recess defined longitudinally in said outer periphery of said rotator, and a pushing assembly having a connection member and a first member rotatably connected to a first end of said connection member, a second member rotatably connected to a second end of said connection member and fixedly received in said first recess, a torsion spring connected between said first member and said second member, said first member rotatably contacting an inner periphery of said casing.

* * * * *